US007156393B2

(12) United States Patent
Wagnon et al.

(10) Patent No.: US 7,156,393 B2
(45) Date of Patent: Jan. 2, 2007

(54) FISHING BOARD GAME

(76) Inventors: Jean-Claude Wagnon, Lot 814, Hundred of Ripon, Streaky Bay, South Australia 5680 (AU); Evelyne Wagnon, Lot 814, Hundred of Ripon, Streaky Bay, South Australia 5680 (AU)

( * ) Notice: Subject to any disclaimer, the term of this patent is extended or adjusted under 35 U.S.C. 154(b) by 49 days.

(21) Appl. No.: 10/934,541

(22) Filed: Sep. 3, 2004

(65) Prior Publication Data

US 2005/0077677 A1 Apr. 14, 2005

(30) Foreign Application Priority Data

Mar. 6, 2002 (AU) ..... 2003200859

(51) Int. Cl.
*A63F 3/00* (2006.01)

(52) U.S. Cl. ..... 273/244; 273/236

(58) Field of Classification Search ..... 273/236, 273/243, 244
See application file for complete search history.

(56) References Cited

U.S. PATENT DOCUMENTS

| | | | | |
|---|---|---|---|---|
| 2,496,096 | A * | 1/1950 | Kelley | 273/140 |
| 3,888,489 | A * | 6/1975 | Kane | 273/244 |
| 4,003,578 | A * | 1/1977 | Jones | 273/244 |
| 5,176,385 | A * | 1/1993 | Tagliaferro | 273/244 |
| 6,257,576 | B1 * | 7/2001 | Pontacoloni | 273/244 |
| 6,669,196 | B1 * | 12/2003 | Washko | 273/243 |
| 6,789,798 | B1 * | 9/2004 | Adams et al. | 273/239 |

* cited by examiner

*Primary Examiner*—Vishu Mendiratta
(74) *Attorney, Agent, or Firm*—Craig A. Fieschko, Esq.; DeWitt Ross & Stevens S.C.

(57) ABSTRACT

A fishing board game to assist in anglers learning the fishing requiremtns in various areas of fishing, such as local fishing regulations, legal sizes, legal limits, boating safety.

10 Claims, 5 Drawing Sheets

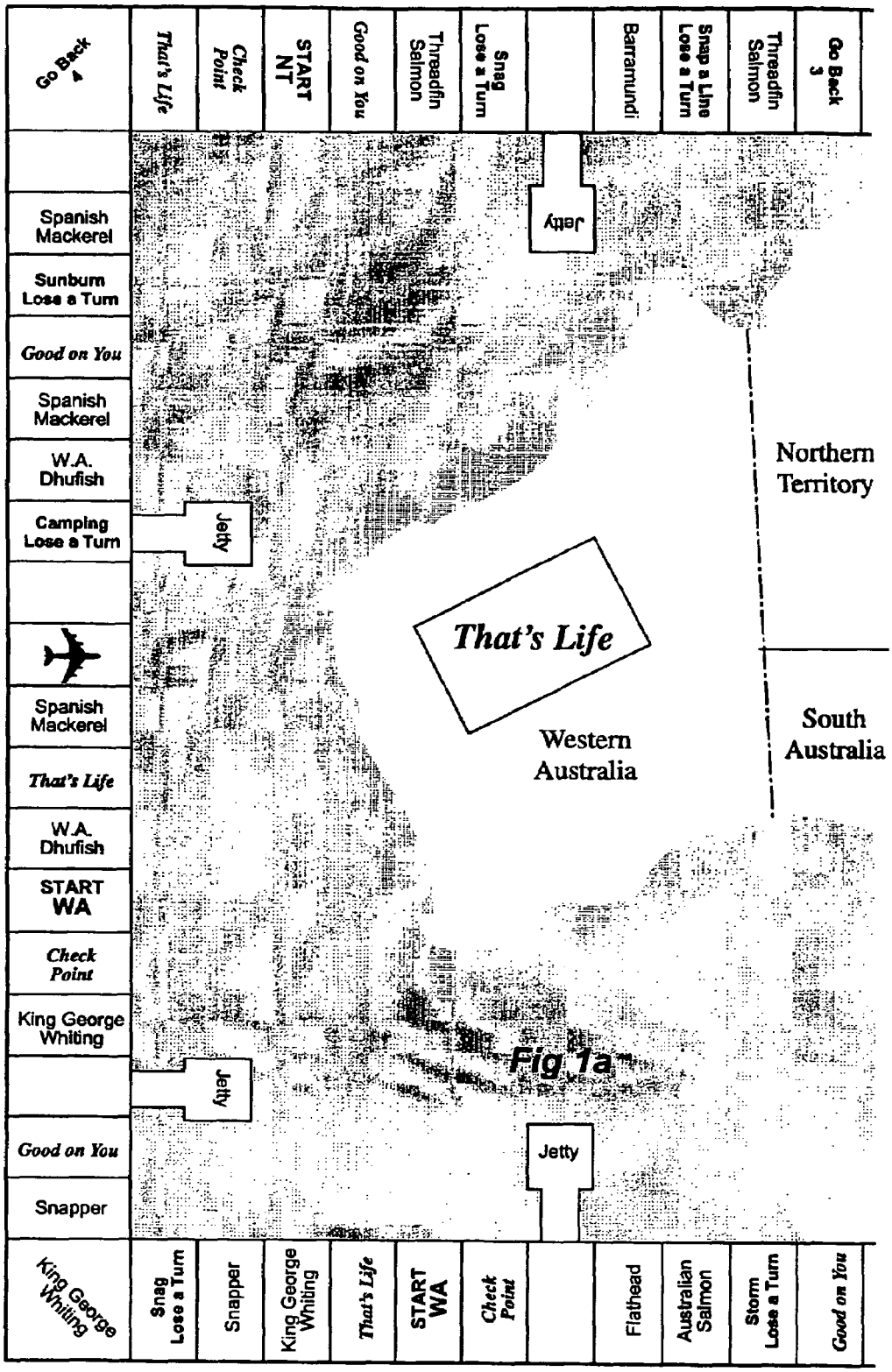
Go Back 3
Threadfin Salmon
Snap a Line Lose a Turn
Barramundi
Jetty
Snag Lose a Turn
Threadfin Salmon
Good on You
START NT
Check Point
That's Life
Go Back 4
Snapper
Good on You
Jetty
King George Whiting
Check Point
START WA
W.A. Dhufish
That's Life
Spanish Mackerel
Jetty
Camping Lose a Turn
W.A. Dhufish
Spanish Mackerel
Good on You
Sunburn Lose a Turn
Spanish Mackerel
King George Whiting
Snag Lose a Turn
Snapper
King George Whiting
That's Life
START WA
Check Point
Flathead
Australian Salmon
Storm Lose a Turn
Good on You
Jetty
Northern Territory
South Australia
Western Australia
That's Life
Fig 1a

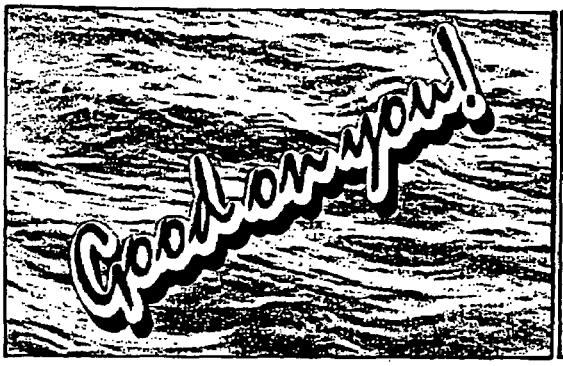

You always bring your rubbish back home to dispose of it properly.

You know that some wildlife can ingest plastic bags and die.

*IMMEDIATE BONUS: 20 points*

You always have your ruler so you can make sure you don't keep undersize fish.

*IMMEDIATE BONUS: 15 points*

Go to the *next fish square* representing a fish you *do not* have.

Try to catch it with the roll of the 2 dice (one throw).

You always take care where you anchor your boat. You don't want to damage reefs or other sensitive areas.

*IMMEDIATE BONUS: 20 points*

Go to the *next fish square* representing a fish you *do not* have.

Try to catch it with the roll of the 2 dice (one throw).

An old timer has given you a map of his secret fishing spots. When you feel that the time is right, you go straight to the square representing that fish you can't catch and stay there until you catch it.

*Don't be caught with this card in your possession at the end of the game or you will be penalized 50 points.*

You always bring your rubbish back home to dispose of it properly.

You know that an old line thrown overboard can cause some wildlife to be entangled and die.

*IMMEDIATE BONUS: 20 points*

Fig 2

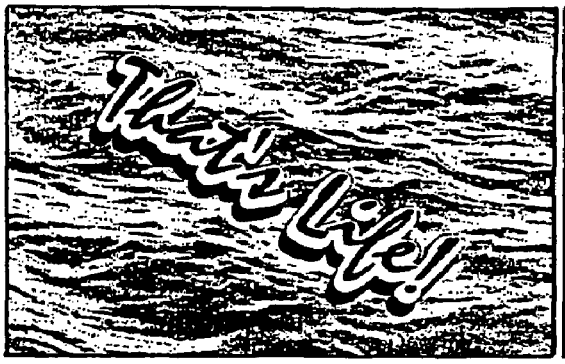

You're grumpy because you didn't catch any fish on this trip

There is more to fishing than catching fish... Enjoy the little things in life like nature good company, relaxation...

*IMMEDIATE PENALTY: 10 points*

You forgot to put your safety gear back in the boat after cleaning it. You have to be more careful.

*IMMEDIATE PENALTY: 20 points*

You don't care where you anchor your boat. You could damage the reef underneath.

From now on, be more careful...

*IMMEDIATE PENALTY: 20 points*

You run out of bait.

*Return to your last stop to get some more.*

You're not careful enough when handling fish before releasing them, they may die because of you.

You must keep them wet and return them quickly and gently to the water and make sure you don't hurt them.

*IMMEDIATE PENALTY: 15 points*

You are stopped by the Defender of the Seas in a patrol boat.

*This is an 'on the spot' check.*

You forgot your tackle box.

*Go back to your last stop to get it.*

*Fig 3*

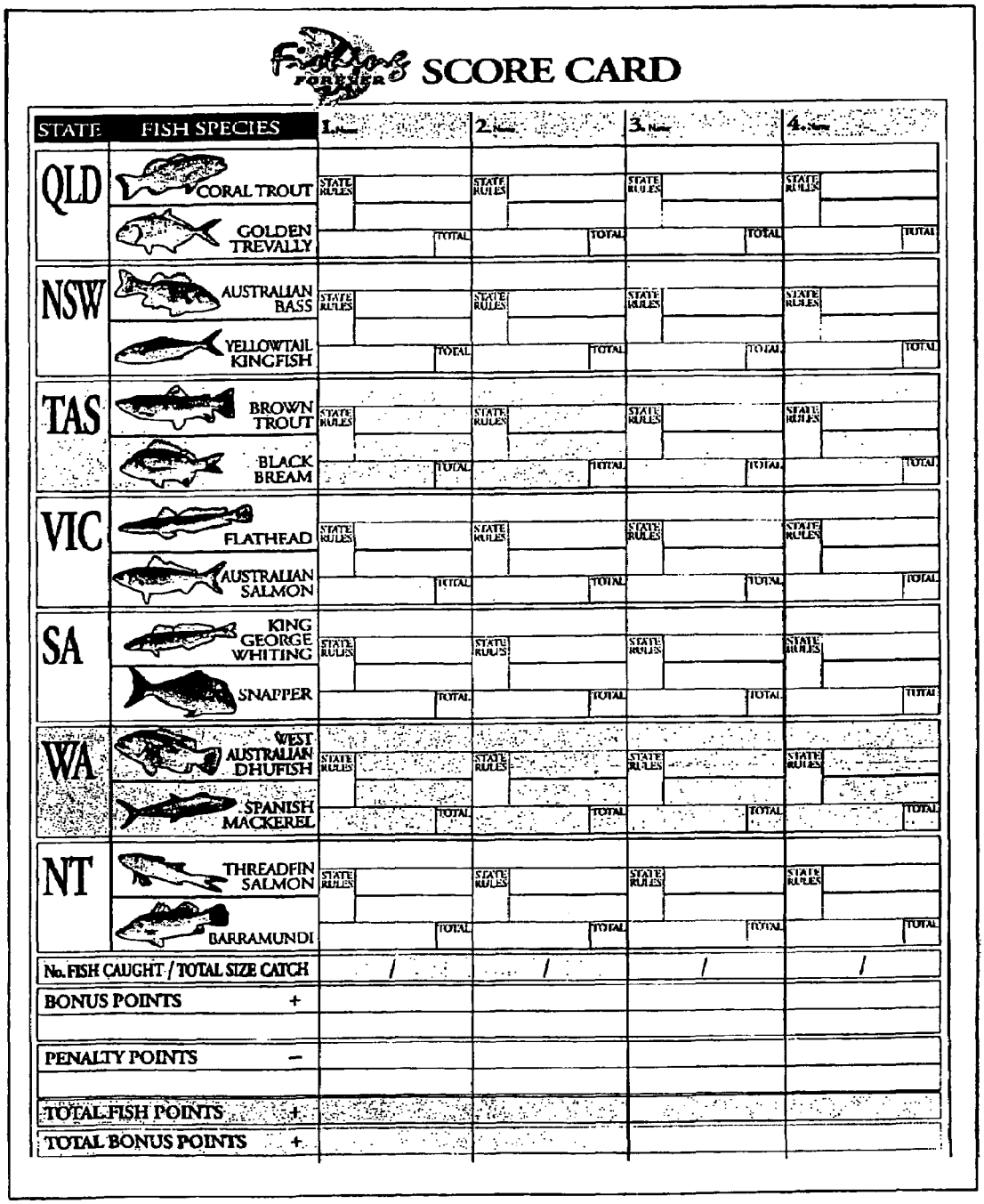

FishOn FOREVER SCORE CARD

| STATE | FISH SPECIES | 1. Name | 2. Name | 3. Name | 4. Name |
|---|---|---|---|---|---|
| QLD | CORAL TROUT | STATE RULES | STATE RULES | STATE RULES | STATE RULES |
| | GOLDEN TREVALLY | TOTAL | TOTAL | TOTAL | TOTAL |
| NSW | AUSTRALIAN BASS | STATE RULES | STATE RULES | STATE RULES | STATE RULES |
| | YELLOWTAIL KINGFISH | TOTAL | TOTAL | TOTAL | TOTAL |
| TAS | BROWN TROUT | STATE RULES | STATE RULES | STATE RULES | STATE RULES |
| | BLACK BREAM | TOTAL | TOTAL | TOTAL | TOTAL |
| VIC | FLATHEAD | STATE RULES | STATE RULES | STATE RULES | STATE RULES |
| | AUSTRALIAN SALMON | TOTAL | TOTAL | TOTAL | TOTAL |
| SA | KING GEORGE WHITING | STATE RULES | STATE RULES | STATE RULES | STATE RULES |
| | SNAPPER | TOTAL | TOTAL | TOTAL | TOTAL |
| WA | WEST AUSTRALIAN DHUFISH | STATE RULES | STATE RULES | STATE RULES | STATE RULES |
| | SPANISH MACKEREL | TOTAL | TOTAL | TOTAL | TOTAL |
| NT | THREADFIN SALMON | STATE RULES | STATE RULES | STATE RULES | STATE RULES |
| | BARRAMUNDI | TOTAL | TOTAL | TOTAL | TOTAL |
| No. FISH CAUGHT / TOTAL SIZE CATCH | | / | / | / | / |
| BONUS POINTS + | | | | | |
| PENALTY POINTS − | | | | | |
| TOTAL FISH POINTS + | | | | | |
| TOTAL BONUS POINTS + | | | | | |

*Fig 4*

FISHING BOARD GAME

FIELD OF THE INVENTION

This invention relates to a board game, more particularly to an exciting and educational board game on fishing.

BACKGROUND OF THE INVENTION

In any country such as Australia there are a large number of different fish in the coastal waters adjacent the various states, each of which may have different fishing regulations.

SUMMARY OF THE INVENTION

It is an object of this invention to provide a board game which is both interesting and educational and which can be played by 2 up to 4 or more players of all ages from children to adults.

While the game has been described with particular reference to Australia, it is to be realised the basic principle of the game can be applied to any country or fishing area.

Thus there is provided according to the invention a board game with the fishing area divided into a number of zones each having its particular variety of fish and regulations, at least one player allocated to each zone, whereby each player has to aim to catch all the fish in that zone, bonus point cards and penalty point cards being provided, and two dice, one a game die and the other a fish die.

Preferably the game die (which may be white) indicates the number of squares the fisher is to advance around the board and the fish die which is of a different color, such as green is used to indicate the size of fish caught.

Preferably there are three sets of cards, zone cards selected at the beginning of the game, the plus bonus points cards entitled "Good on you" and the penalty cards called "That's life".

BRIEF DESCRIPTION OF THE DRAWINGS

In order to more fully describe the invention reference will now be made to the accompanying drawings in which:

FIG. 4 is an example of the score board.

DETAILED DESCRIPTION OF PREFERRED VERSIONS OF THE INVENTION

Figure 1B:
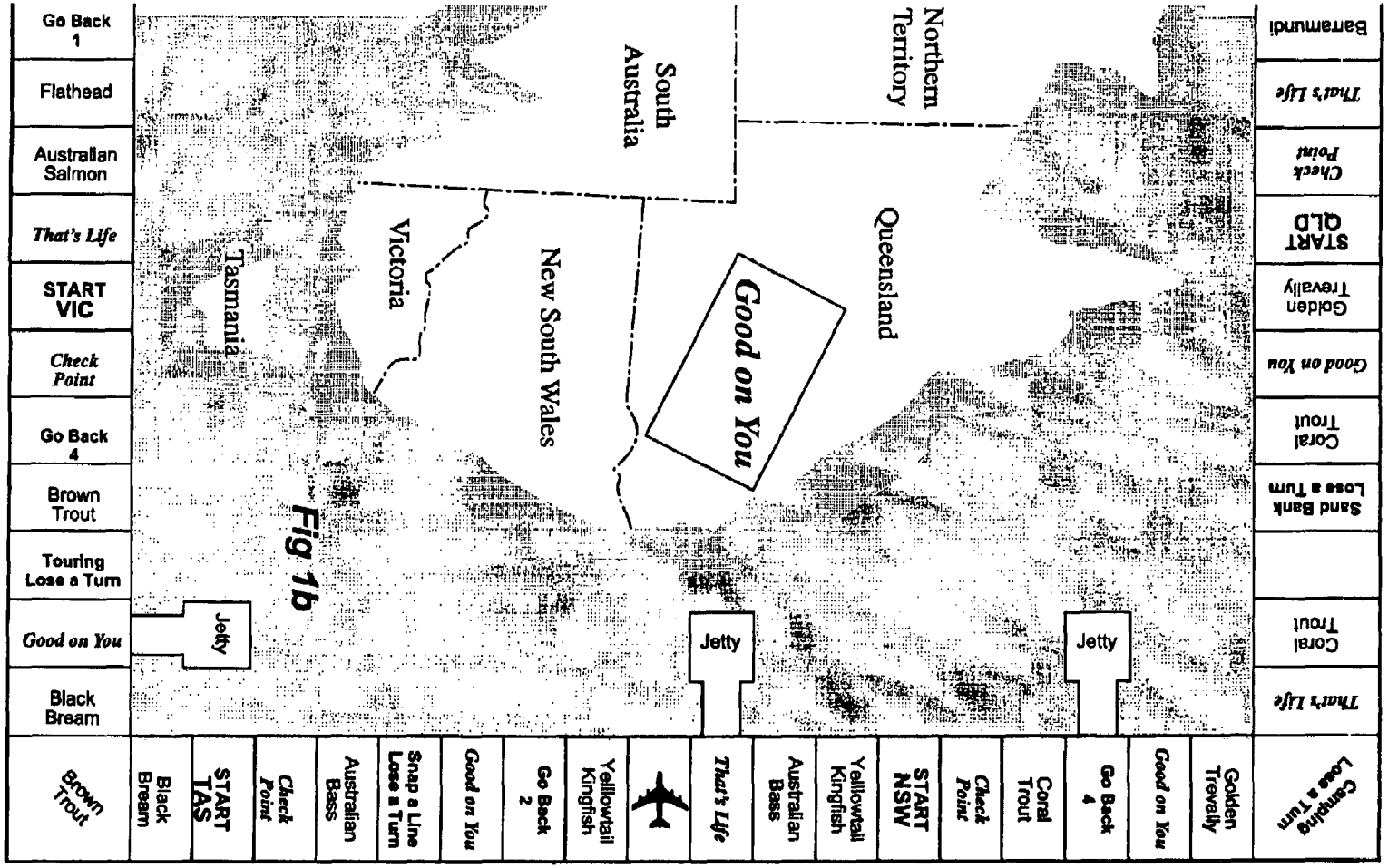
FIGS. 1(*a*) and 1(*b*) are a plan view of the board as applied to Australia, FIG. 2 are samples of the "Good on you" bonus cards, FIG. 3 are samples of the "That's Life" penalty cards.

It is to be noted FIGS. 2 and 3 show examples only of the type of cards in each pack, many more bonus cards and penalty cards are included in the respective packs.

The board in this embodiment shows a map of Australia and Tasmania showing the various states and territories having a coast line. Around the map are a series of squares divided into a series of zones, one zone corresponding to each state or territory. For convenience in describing the game in relation to Australia, each zone will be called a state. When the game is applied to other countries or fishing areas the zones may either be called zones or a name applicable to that fishing area.

The squares allocated to each state include some of the fish able to be caught by shore, beach, rock or estuary anglers for that state. Also there is a jetty from which anglers may fish for each state together with a "That's Life" and "Good on you" square, plus one or more delaying or lose a turn squares.

Each fisher (player) will make one or several imaginary trips around Australia. The aim is to try to catch at least one of each species of fish represented on the board. The game ends in one of two ways:

As soon as a player has caught the 13 different fish of the game or

As soon as the time is up if the game is played for a given length of time.

In each case the points are counted at the end of the game and the winner is the fisher ending up with the most points.

The game is designed for 2 to 4 players (but more can play) ages 7 to 107.

The first player is the one who, after throwing one dice, has the smaller number of points. The next player will be the person sitting on his or her left, and so on in a clockwise direction.

There are 7 cards, each representing one of Australia's states or territory (however, from now on, wherever the word "state" is used, it will mean 'state or territory'). State cards can be spread on the board face down, for players to pick one card. This will be their starting state. They will keep the card, leave it in view of everyone, and they will automatically get the regulations (and licences if they are required) of their starting state. This will be recorded on the scoreboard.

A scorekeeper will be elected by the fishers. This person will keep a record of the state's regulations, the catch and the bonus or penalty points of each fisher on the scoreboard. The scorekeeper does not have to be a player.

The Dice

There are 2 dice, one white and one green. The white dice (game dice) indicates the number of squares the fisher is advancing, the green dice (fish dice) is used to determine the size of the fish caught, as explained later. Players play with the white dice at all times, then, upon landing on a fish square, they will play again with both dice.

The Squares

Each state has a starting square, and at the beginning of the game the player places the token on the start square and receives the regulations for that state. As the player moves around the board, the player should try to land on the start square for that state to obtain the regulations. If not successful the player may pass that turn and try again in the next round. Only one pass is permitted. The second time though, the player must move. A player need not pass and try to obtain the regulations, however there is the risk of being caught by the fishing inspector who will check this point as well as others mentioned later. The scorekeeper (who will double also as the fishing inspector when needed) will keep a record of the players regulation status. Once the regulations and licences of a state have been obtained, these are kept throughout the game even in a second or subsequent round.

When a player lands on a square with a fish, there is the chance of catching a fish. To catch a fish, the player immediately plays again with both dice. To catch the fish the fish dice must be higher than the game dice. The difference between the two dice gives the 'size' of the fish caught.

Example: fish dice —5, game dice —3, a size 2 fish has been caught.

Therefore, the sizes can vary between 1 (i.e. fish dice —6, game dice —5) and 5 (fish dice —6, game dice —1). If the difference is 0 or a minus figure (game dice higher than fish dice), a fish has not been caught.

The scorekeeper will record any fish caught on the board. At the end of the game, the size of each fish is multiplied by 10 to give a number of points: size 1=10 points, size 2=20 points, size 3=30 and so on.

If a fish is caught, the player plays again.

Jetty Squares

These squares (one in each state) are outside the main circuit on which a player may land.

| JETTY | | | | | |
|---|---|---|---|---|---|
| STORM | GOOD ON YOU! | FLAT HEAD | AUSTRALIAN SALMON | THAT'S LIFE! | VIC |

As per the above, if a player is in the starting square for the state of Victoria, a 5 has to be thrown to have the opportunity to land on the jetty. However, the player is only allowed to go only if the player has not caught the different species of fish in the player's state, and then, only if the player want to. Once on the jetty, the player plays with the 2 dice, starting on the next turn. If the player has not caught any fish in that state yet, when one is caught, the player can choose which species has been caught first (of course, if there is only one species to catch like in Tasmania or if you already caught one of the 2 species, then the other one has been caught.

A player can stay on the jetty all the species of fish of the state have been caught, but once all have been caught, the next roll of the game dice will see the player mover around the board again. The player may also elect to leave earlier if desired.

If a player lands on a GOOD ON YOU or a THAT'S LIFE square the player picks up the top card, and carries out the instructions on that card. The GOOD ON YOU cards are cards noting good angling practices and give bonus points for these practices. The THAT'S LIFE cards note bad angling practices and penalty points are allocated for these bad practices.

There are Lose a Turn squares. They are as follows: CAMPING—SNAG—SUNBURN—TOURING—SAND-BANK—STORM—SNAP A LINE. The Sunburn square is the only one on which the player may not lose a turn. If the GOOD ON YOU card saying that you "Slip, Slop, Slap" is picked and the player has it when landing on the "sunburn" square a turn is not lost and the scorekeeper will record the number of points to add to the bonus score and then the card is replaced under the deck of GOOD ON YOU cards.

The Fishing Inspector Square. A responsible player will play on, however if a player is guilty of an offence the following penalties may apply:

If the player does not have the regulations for that state, the player is sent back to the start of that state (and obtain the regulations at the same time). The scorekeeper will take note of the number of points to be added to the penalty score.

If "Over the bag limit" card and/or the "Undersize fish" then, all the fish caught in that state are lost, and the player is also sent back to the start of the state. The penalty points are recorded. If the player does not have any of the fish of that state, the card(s) are put back under the pile of "That's Life" cards and no penalty will be recorded.

The Good on You squares. The player draws the card that is on top of the "Good on You" card deck. These cards give a bonus of some kind to the player for being a responsible fisher. They are kept secret until needed unless it is an immediate bonus. One of these cards is a transport card, and if a player draws the card the player may elect to be transported, such as by an airline ticket to a zone of fishing in which the player has not caught any of all of the fish for that zone, this card can be held and used when desired by the player.

There are 2 kinds of Trophy cards included in the "Good on You" card deck:

1. You want to keep your trophy.
2. You prefer to take a photo of your trophy and release it.

These cards are kept until a size 5 fish Is caught. The scorekeeper will then double the size of the fish, making it a trophy, a size 10 fish worth 100 points and will also add the points given on the card to the bonus score. When a card is used it is replaced under the deck of "Good on You" cards.

The That's Life squares. These cards represent the different problems one can encounter while fishing, as well as some of the illegal things that is not supposed to do and are penalised accordingly. These cards have to be read aloud for all players to hear.

If the player first to finish the game is in possession of any or both the following:

"Over the bag limit" and/or "Undersize fish" cards the "All species bonus" of 100 points will not be awarded. Also, any fisher (including the first to finish the game) ending up with the greater number of fish AND with any of the 2 abovementioned cards, he or she will not get the "Greater number of fish bonus" either.

Note

If one of the cards that can be kept (or have to keep, in the case of the "That's Life" cards) when the player already has one of the same, the scorekeeper will record the number of bonus or penalty points of the second card and it can be replaced under the appropriate deck of cards.

If a "That's Life" card is picked and its opposite "Good on You" card is held by the same player, or vice versa, they cancel each other out and both can be replaced under their respective deck, always after showing the cards to the players. No bonus or penalty points are recorded.

Cards are to be replaced immediately under the deck of cards they are coming from, unless specified otherwise.

At the end of the game, all the cards must be shown so the scorekeeper can assess the bonus and/or penalty to be allocated.

Score

The fish sizes recorded all through the game are now added up and the total is multiplied by 10.

If the "Over the bag limit" and/or the "Undersize fish" cards are not held at the finish of the game, then the following bonus may be awarded if appropriate:

| | |
|---|---|
| All species | 100 points |
| Greater number of fish | 50 points |
| No regulations, penalty | 10 points per state |

Also added or subtracted are the points recorded by the scorekeeper: bonus and penalty points accumulated throughout the game.

Thus it will be seen that there is provided according to this invention a board game which is applied to fishing. Although the preferred embodiment has been described with reference to fishing around the Australian coasts it is to be realised that the invention can be adapted to any fishing area whether coastal, around any land mass, whether off shore or deep sea fishing, or whether fishing inland rivers, streams or lakes. Accordingly the "That's life" and "Good on you" cards can be adapted and modified as desired depending upon the specific fishing area.

Although one preferred embodiment of the invention has been described in some detail the invention is not to be limited thereto but can include variations and modifications falling within the spirit and scope of the invention.

The invention claimed is:

1. A method of playing a fishing board game, including the steps of providing a board illustration a fishing area, dividing the fishing area into a plurality of fishing zones, providing a series of squares surrounding the fishing area, groups of zone squares corresponding to the fishing zones, each group of zone squares having a start square, named fish squares, penalty square, a bonus square, and one or more lose a turn squares, a deck of bonus cards, a deck of penalty cards, and a game die and a fish die, and including the further steps of allocating a player to each zone and starting on the respective start square to receive the regulations for that zone, playing the game die to move around the series of squares, and when landing on a fish square playing both dice to indicate whether a fish has been caught by the fish die having a greater number than the game die, the difference being the size of the fish to gain points, and if the fish die is not grater than the game die no fish has been caught.

2. A method as defined in claim 1 wherein the deck of penalty cards includes cards noting illegal fishing activities, and when a player lands on a penalty square the player takes one of these cards and retains the card, the zone squares including a fishing inspector square and when a player lands on this square the player must disclose the penalty cards and have the penalty points deducted.

3. A method as defined in claim 1 wherein the deck of bonus cards includes cards noting good fishing practices and when a player lands on a bonus square, the uppermost card is taken and the player follows the instructions on the card and can gain bonus points.

4. A method as defined in claim 1 wherein each set of zone squares includes a jetty square from which a player may fish by using the two dice.

5. A method of playing a fishing board game by two or more players including the steps of:

A. providing a board bearing an illustration of:

I. a plurality of fishing zones which define a fishing area,

II. squares surrounding the fishing area, the squares including groups of zone squares wherein each group of zone squares:

i. corresponds to one of the fishing zones, and ii. includes a start square and one or more fish squares, B. providing a game die, and C. providing a fish die, the method including the steps of:

a. allocating each player to a fishing zone;

b. having each player:

(1) start on the start square of the zone squares for the player's fishing zone, (2) play the game die to move about the squares surrounding the fishing area, and (3) when landing on a fish square, playing both dice, wherein if the fish die has a greater number than the game die, points are accorded to the player in dependence on the difference between the die numbers.

6. A method as defined in claim 5 wherein:

a. each group of zone squares further includes a penalty square and a fishing inspector square;

b. a deck of penalty cards is also provided, each penalty card having penalty points assigned;

c. when a player lands on a penalty square the player takes and retains a penalty card;

d. when a player lands on a fishing inspector square the player deducts any penalty points assigned by any retained penalty cards.

7. A method as defined in claim 5 wherein:

a. each group of zone squares further includes a bonus square;

b. a deck of bonus cards is also provided, each bonus card having instructions thereon;

c. when a player lands on a bonus square the player follows any instructions on the uppermost bonus card.

8. A method as defined in claim 5 wherein:

a. each group of zone squares further includes a bonus square;

b. a deck of bonus cards is also provided, at least some of the bonus card having bonus points assigned;

c. when a player lands on a bonus square the player gains any bonus points assigned by the uppermost bonus card.

9. A method as defined in claim 5 wherein each group of zone squares includes a jetty square, wherein if a player lands on the jetty square, the player plays both dice in the same manner as if the player landed on a fish square.

10. A method as defined in claim 5 wherein each group of zone squares further includes one or more lose a turn squares, wherein if a player lands on a lose a turn square, the player loses his or her next turn.

* * * * *